US008444405B2

(12) United States Patent
Hollister et al.

(10) Patent No.: US 8,444,405 B2
(45) Date of Patent: May 21, 2013

(54) OVERMOLDED ROTOR

(76) Inventors: Matthew Hollister, Hudson, WI (US); Doug Purdy, Edina, MN (US); Dustin Featherstone, Taylors Falls, MN (US)

( * ) Notice: Subject to any disclaimer, the term of this patent is extended or adjusted under 35 U.S.C. 154(b) by 712 days.

(21) Appl. No.: 12/568,975

(22) Filed: Sep. 29, 2009

(65) Prior Publication Data

US 2010/0080723 A1 Apr. 1, 2010

Related U.S. Application Data

(60) Provisional application No. 61/101,369, filed on Sep. 30, 2008.

(51) Int. Cl.

| | |
|---|---|
| ***F03C 4/00*** | (2006.01) |
| ***F04C 2/00*** | (2006.01) |
| ***F04C 29/00*** | (2006.01) |

(52) U.S. Cl.

USPC ..... 418/152; 418/154; 418/225; 264/272.11; 264/272.19

(58) Field of Classification Search ..... 418/152, 418/154–155, 178, 179, 225–227; 264/272.11, 264/272.19

See application file for complete search history.

(56) References Cited

U.S. PATENT DOCUMENTS

| | | | | |
|---|---|---|---|---|
| 3,207,078 | A * | 9/1965 | Cook | 418/225 |
| 3,734,654 | A * | 5/1973 | Burenga et al. | 418/152 |
| 3,826,589 | A | 7/1974 | Frank et al. | |
| 4,086,043 | A | 4/1978 | Howe | |
| 4,198,195 | A * | 4/1980 | Sakamaki et al. | 418/152 |
| 4,762,465 | A | 8/1988 | Friedrichs | |
| 5,027,654 | A * | 7/1991 | Bergamini | 418/225 |
| 5,122,032 | A | 6/1992 | Shields et al. | |
| 5,867,900 | A | 2/1999 | Larson et al. | |
| 5,990,588 | A | 11/1999 | Kliman et al. | |
| 2009/0238706 | A1 * | 9/2009 | Featherstone | 418/225 |

FOREIGN PATENT DOCUMENTS

| | | |
|---|---|---|
| DE | 3225498 | 1/1984 |
| JP | 59213969 | 12/1984 |

* cited by examiner

*Primary Examiner* — Theresa Trieu
(74) *Attorney, Agent, or Firm* — Merchant & Gould PC

(57) ABSTRACT

A fluid device includes a housing and a rotor assembly disposed in the housing. The rotor assembly includes a core and a coating. The core has a first surface, an oppositely disposed second surface and an outer peripheral surface that extends between the first and second surfaces. The core defines a bore that extends through the first and second surfaces. The coating coats at least a portion of the core. The coating is a water-swellable plastic material.

16 Claims, 13 Drawing Sheets

OVERMOLDED ROTOR

CROSS-REFERENCE TO RELATED APPLICATIONS

The present application claims priority to U.S. Provisional Patent Application Ser. No. 61/101,369, which is entitled "Overmolded Rotor" and was filed on Sep. 30, 2008. The above identified disclosure is hereby incorporated by reference in its entirety.

BACKGROUND

Conventional rotary fluid devices are used for a variety of purposes such as to transfer fluid (i.e., water, oil, etc.) from one location to another (e.g., a pump) or to convert fluid pressure into torque (e.g., a motor). Most conventional rotary fluid devices include a rotor. The rotor cooperates with other components of the conventional rotary fluid device to achieve its pumping or motoring purpose.

In conventional rotary fluid devices, the rotor is typically an all-metal design. However, during normal operation, localized welding and splitting ("galling") can occur between the rotor and the immediately adjacent component as a result of friction between the rotor and the immediately adjacent component. This localized welding and splitting can significantly reduce the life of the conventional rotary fluid device.

SUMMARY

An aspect of the present disclosure relates to a fluid device having a housing and a rotor assembly disposed in the housing. The rotor assembly includes a core and a coating. The core has a first surface, an oppositely disposed second surface and an outer peripheral surface that extends between the first and second surfaces. The core defines a bore that extends through the first and second surfaces. The coating coats at least a portion of the core. The coating is a water-swellable plastic material.

Another aspect of the present disclosure relates to a rotor assembly that is adapted for rotation in a fluid device. The rotor assembly includes a core having a first surface and an oppositely disposed second surface. Each of the first and second surfaces include a central portion and a radial portion. The radial portion is recessed relative to the central portion. The core has an outer peripheral surface that extends between the first and second surfaces. The rotor assembly further includes a coating that is applied to the radial portion of each of the first and second surfaces of the core. In one embodiment, the coating is a water-swellable plastic material.

Another aspect of the present disclosure relates to a method of applying a coating to a core of a rotor assembly. The method includes locating a core of a rotor assembly in a mold. The mold is filled with a molten water-swellable plastic material to form an outer surface of the rotor assembly. The method further includes cooling the rotor assembly.

Another aspect of the present disclosure relates to a displacement assembly for pumping fluid. The displacement assembly includes a ring having an inner surface that defines a pumping chamber. A rotor assembly is disposed in the pumping chamber and is adapted for rotation in the pumping chamber. The rotor assembly includes a core and a coating. The core includes a first surface, an oppositely disposed second surface and an outer peripheral surface that extends between the first and second surfaces. The first and second surfaces include a central portion and a radial portion. The core defines a central bore that extends through the central portions of the first and second surfaces. The core further defines a plurality of pockets that extend radially inward from the outer peripheral surface. The coating coats the radial portion of the first and second surfaces of the core. The coating is a plastic material that extends outwardly from the radial portion of each of the first and second surfaces by an axial distance that is in a range of about 0.005 inches to about 0.125 inches as measured from the central portion. The displacement assembly further includes a plurality of rollers with one roller being disposed in each of the plurality of pockets of the rotor assembly.

The inner surface of the ring, the plurality of pockets of the rotor assembly and the plurality of rollers cooperatively define a plurality of volume chambers.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Many conventional fluid pumps include rotating kits that transport or pump fluid from one location to another location. In order for the rotating kit to operate efficiently, small clearances between axial ends of the rotating kit and the immediately adjacent components of the conventional fluid pump are required to minimize potential leakage. However, as a result of these small clearances, the conventional fluid pump becomes susceptible to "galling." Galling is the localized welding and separating of parts in contact that creates areas of high friction that often result in premature failure of the conventional fluid pump.

In order to minimize the likelihood of galling between the axial ends of the rotating kit and the immediately adjacent components, an overmolded rotor assembly will be described. The overmolded rotor assembly of the present disclosure provides a barrier surface that reduces the risk of galling between the axial ends of the rotor assembly and the immediately adjacent components.

Figure 1:
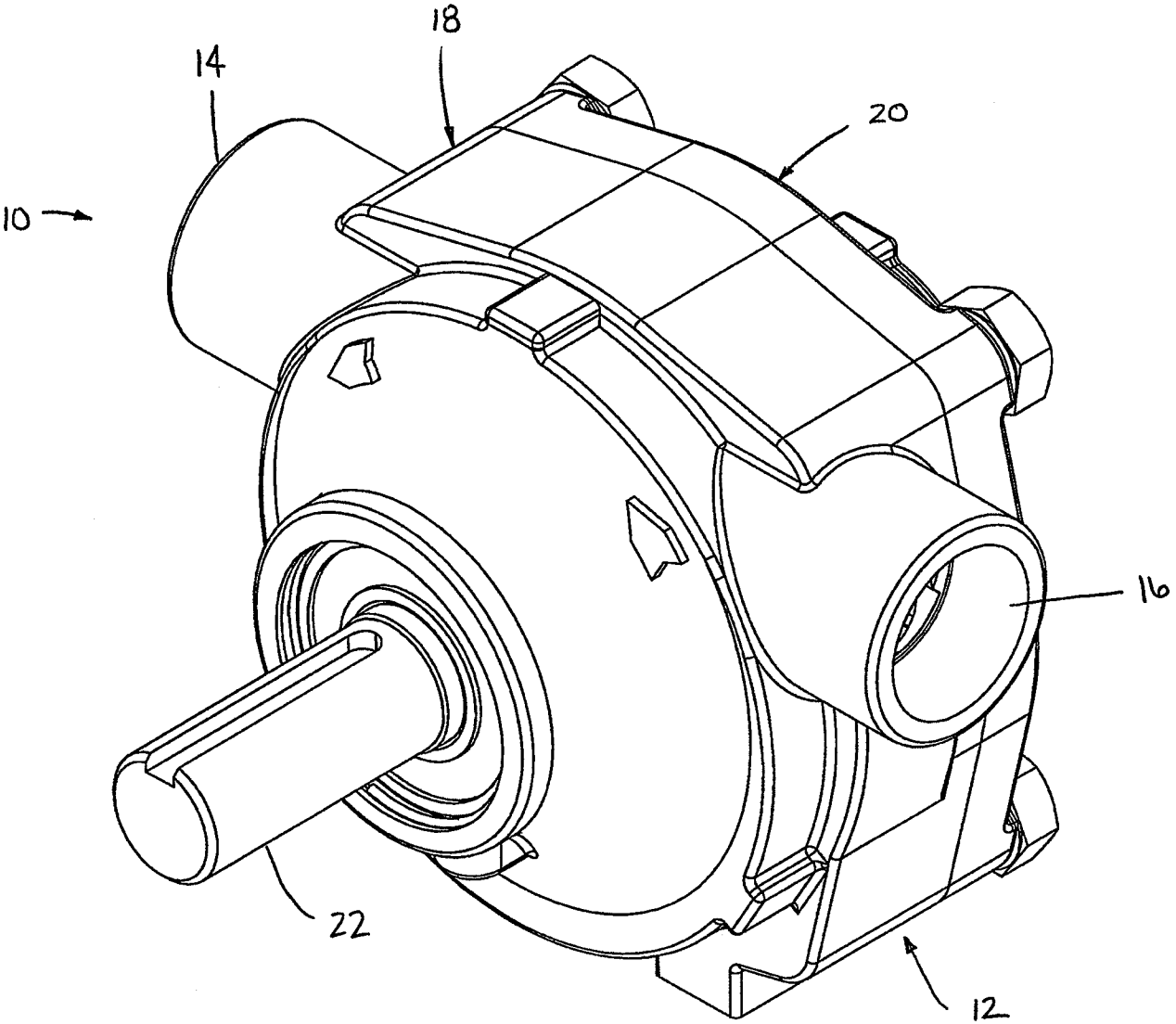
FIG. 1 is an isometric view of a fluid device having exemplary features of aspects in accordance with the principles of the present disclosure.

Referring now to FIG. 1, a rotary fluid device, generally designated 10, is shown. For ease of description purposes, the fluid device 10 will be described herein as a pump. It will be understood, however, that the scope of the present disclosure is not limited to the fluid device 10 being a pump as the fluid device 10 could also be a motor.

In the subject embodiment, the fluid device 10 includes a housing, generally designated 12, having a fluid inlet 14 and a fluid outlet 16. In the subject embodiment, the housing 12 includes a base, generally designated 18 and an end plate, generally designated 20. The fluid device 10 further includes a shaft 22. In the subject embodiment, the shaft 22 is supported by the housing 12.

Figure 2:
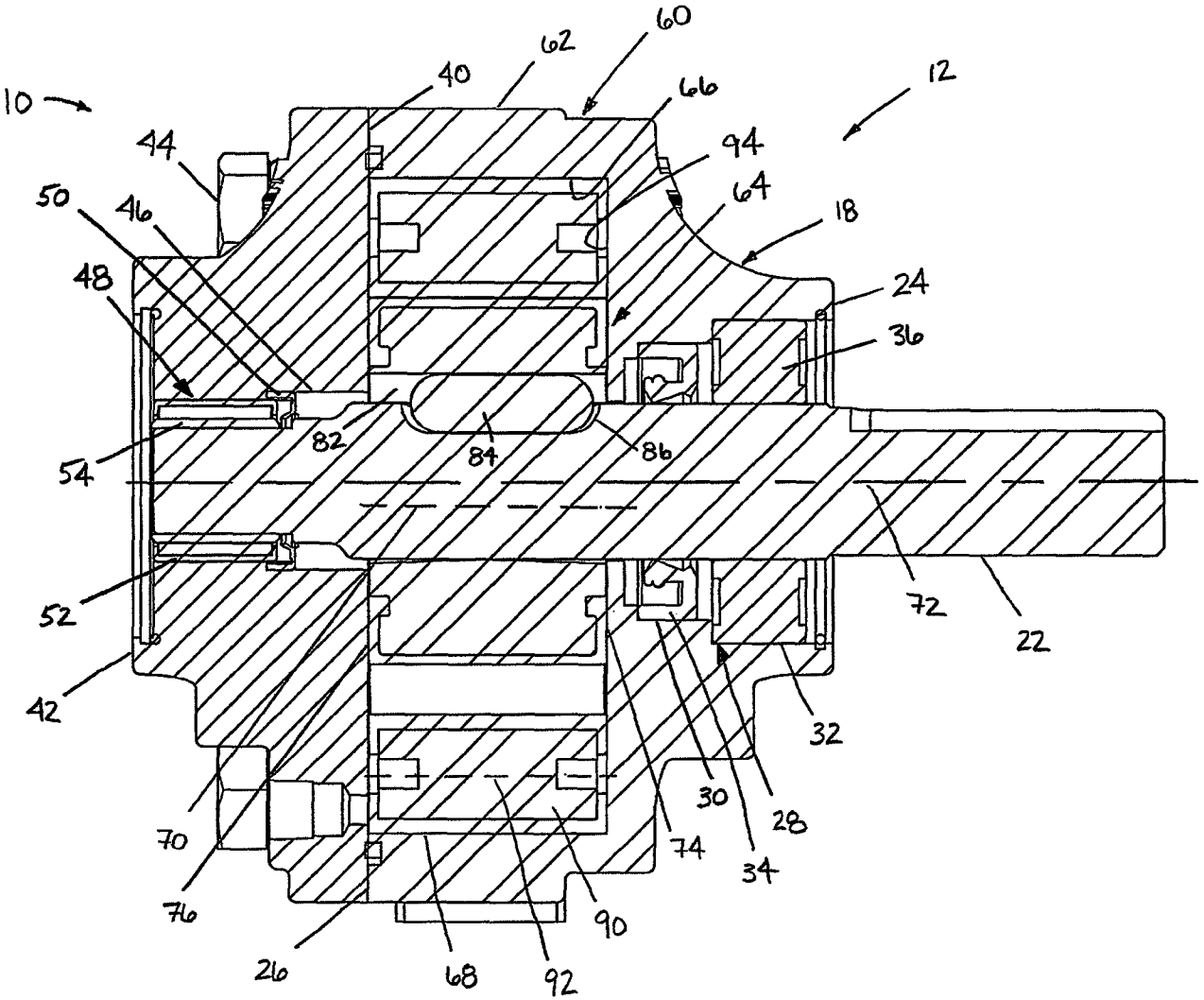
FIG. 2 is a cross-sectional view of the fluid device of FIG. 1.
Figure 3:
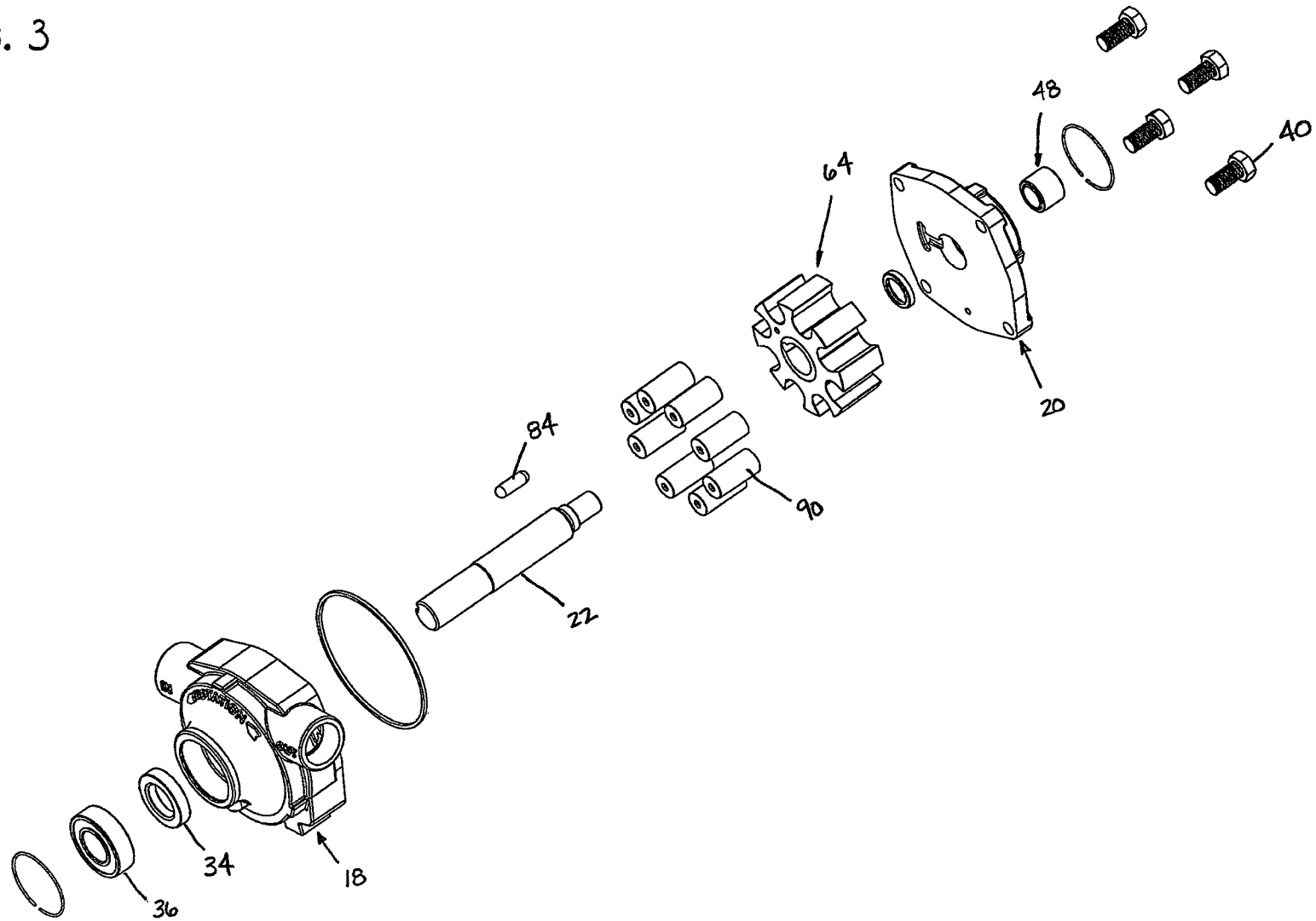
FIG. 3 is an exploded isometric view of the fluid device of FIG. 1.

Referring now to FIGS. 2 and 3, a cross-sectional view and an exploded view of the fluid device 10 are shown. The base 18 of the fluid device 10 includes a first end 24 and an oppositely disposed second end 26. The first end 24 defines a stepped bore, generally designated 28, having a first portion 30 and a second portion 32 with the first and second portions 30, 32 being concentrically oriented. In the subject embodiment, an inner diameter of the first portion 30 is smaller than an inner diameter of the second portion 32.

The first portion 30 of the stepped bore 28 is adapted to receive a radial lip seal 34. In the subject embodiment, the radial lip seal 34 is retained in the first portion 30 of the stepped bore 28 through a press-fit/friction-fit engagement. The radial lip seal 34 is adapted to provide sealing engagement with the shaft 22.

The second portion 32 of the stepped bore 28 is adapted to receive a first bearing set 36. In the subject embodiment, the first bearing set 36 is a ball bearing. The first bearing set 36 is retained in the second portion 32 of the stepped bore 28 through a press-fit/friction-fit engagement. The first bearing set 36 is adapted to receive the shaft 22 and to support the shaft 22 in the base 18.

The end plate 20 of fluid device 10 includes a first end surface 40 and a second end surface 42. The end plate 20 is connectedly engaged with the base 18 through a plurality of fasteners 44. In the subject embodiment, the fasteners 44 provide tight sealing engagement between the first end surface 40 of the end plate 20 and the second end 26 of the housing 12.

In the subject embodiment, the end plate 20 defines a center bore 46 that extends from the first end surface 40 through the second end surface 42 of the end plate 20. Disposed within the center bore 46 is a second bearing set, generally designated 48, and a lip seal 50. The second bearing set 48 is adapted to receive the shaft 22 and to support the shaft 22 in the end plate 20.

In the subject embodiment, the second bearing set 48 is a needle bearing having an outer race 52 and an inner race 54. The outer race 52 of the second bearing set 48 is retained in the center bore 46 through a press-fit/friction-fit engagement. The inner race 54 of the second bearing set 48 is retained on the shaft 22 through a press-fit/friction fit engagement.

In the subject embodiment, the lip seal 50 is retained in the center bore 46 of the end plate 20 through a press-fit/friction-fit engagement. The lip seal 50 is adapted to provide sealing engagement with the shaft 22.

The fluid device 10 further includes a displacement assembly, generally designated 60. The displacement assembly 60 is adapted to communicate a volume of fluid from the fluid inlet 14 of the fluid device 10 to the fluid outlet 16. The displacement assembly 60 includes a ring, generally designated 62, and a rotor assembly, generally designated 64.

In the subject embodiment, the ring 62 is integral with the second end 26 of the base 18. The ring 62 includes an inner surface 66. In the subject embodiment, the inner surface 66 of the ring 62 is generally cylindrical in shape and defines a pumping chamber 68.

The pumping chamber 68 includes a longitudinal axis 70 (shown as a dashed line in FIG. 2). In the subject embodiment, the longitudinal axis 70 of the pumping chamber 68 is eccentrically offset from a central axis 72 (shown as a dashed lined in FIG. 2) defined by the fluid device 10.

Figure 4:
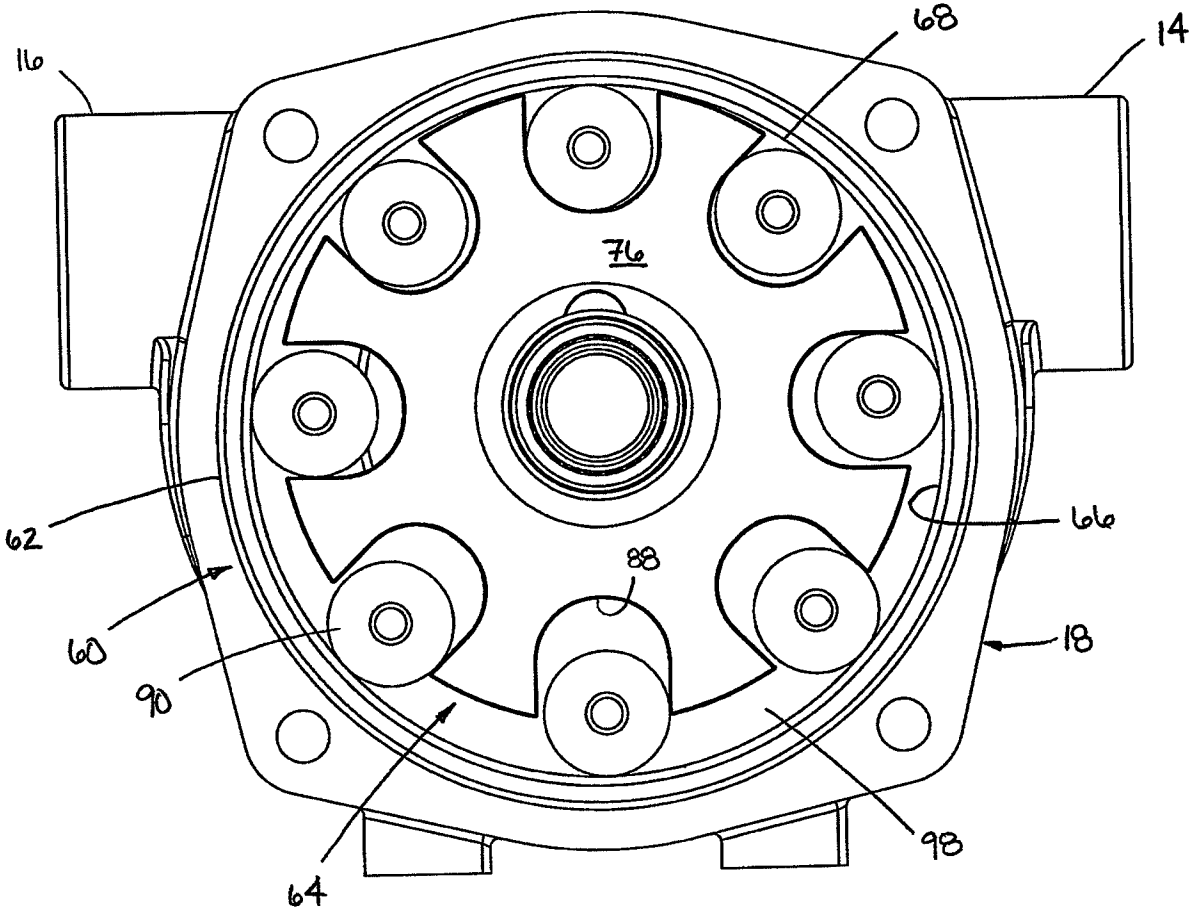
FIG. 4 is a view of a displacement assembly of the fluid device of FIG. 1.

Referring now to FIGS. 2-4, the rotor assembly 64 includes a first axial end 74, an oppositely disposed second axial end 76 and an outer peripheral surface 78 that extends between the first and second axial ends 74, 76. In one embodiment, and by way of example only, the outer peripheral surface 78 has a diameter less than or equal to about 4 inches. In another embodiment, and by way of example only, the outer peripheral surface has a diameter less than or equal to about 3.5 inches. In another embodiment, and by way of example only, the outer peripheral surface has a diameter less than or equal to about 3.25 inches. In another embodiment, and by way of example only, the outer peripheral surface has a diameter in the range of about 2.75 inches to about 3.25 inches.

The rotor assembly 64 defines a central bore, generally designated 80, that extends through the first and second axial ends 74, 76. In one embodiment, the central bore 80 includes an oblique tapered surface 81. The oblique tapered surface 81 of the central bore 80 has been described in U.S. patent application Ser. No. 12/053,190, which is hereby incorporated by reference in its entirety.

In the subject embodiment, the central bore 80 is sized such that the central bore 80 can receive the shaft 22. The central bore 80 defines a notch 82 that is adapted to receive a key 84, which is engaged in a groove 86 defined by the shaft 22. In the subject embodiment, and by way of example only, the central bore 80 defines one notch 82. The disposition of the key 84 in the notch 82 of the rotor assembly 64 and the groove 86 of the shaft 22 allows the shaft 22 and rotor assembly 64 to rotate unitarily or in unison.

The outer peripheral surface 78 defines a plurality of pockets 88. In the subject embodiment, the pockets 88 extend radially inward from the outer peripheral surface 78 and extend axially through the first and second axial ends 74, 76. In the depicted embodiment, the outer peripheral surface 78 defines eight pockets 88. In another embodiment, the outer peripheral surface 78 defines six pockets 88. Each of the plurality of pockets 88 is adapted to receive a roller 90. Each roller 90 includes a center axis 92 (shown as a dashed line in FIG. 2) about which the roller 90 rotates.

The rotor assembly 64 is rotatably disposed in the pumping chamber 68 such that the first axial end 74 is adjacent to an end wall 94 of the base 18 and the second axial end 76 is adjacent to the first end surface 40 of the end plate 20. In the subject embodiment, the rotor assembly 64 rotates about a rotation axis 96 (shown in FIG. 7) that is generally aligned with the central axis 72 of the fluid device 10.

During rotation of the rotor assembly 64 about the rotation axis 96, each of the rollers 90 rotates about the center axis 92 defined by the roller 90 and revolves about the central axis 72 of the fluid device 10. As the rotor assembly 64 rotates in the pumping chamber 68, each roller 90 is in rolling engagement with the inner surface 66 of the pumping chamber 68.

In the subject embodiment, the rotor assembly 64, the rollers 90 and the inner surface 66 of the pumping chamber 68 cooperatively define a plurality of volume chambers 98. As the rotor assembly 64 rotates about the rotation axis 96, which is eccentrically offset from the longitudinal axis 70 of the pumping chamber 68, each of the plurality of volume chambers 98 expands and contracts. The expanding volume chambers 98 are in fluid communication with the fluid inlet 14 of the fluid device 10 while the contracting volume chambers 98 are in fluid communication with the fluid outlet 16. When the fluid device 10 is used as a pump, the fluid is drawn into the expanding volume chambers 98 through the fluid inlet 14 while fluid is expelled from the contracting volume chambers 98 through the fluid outlet 16.

Figure 5:
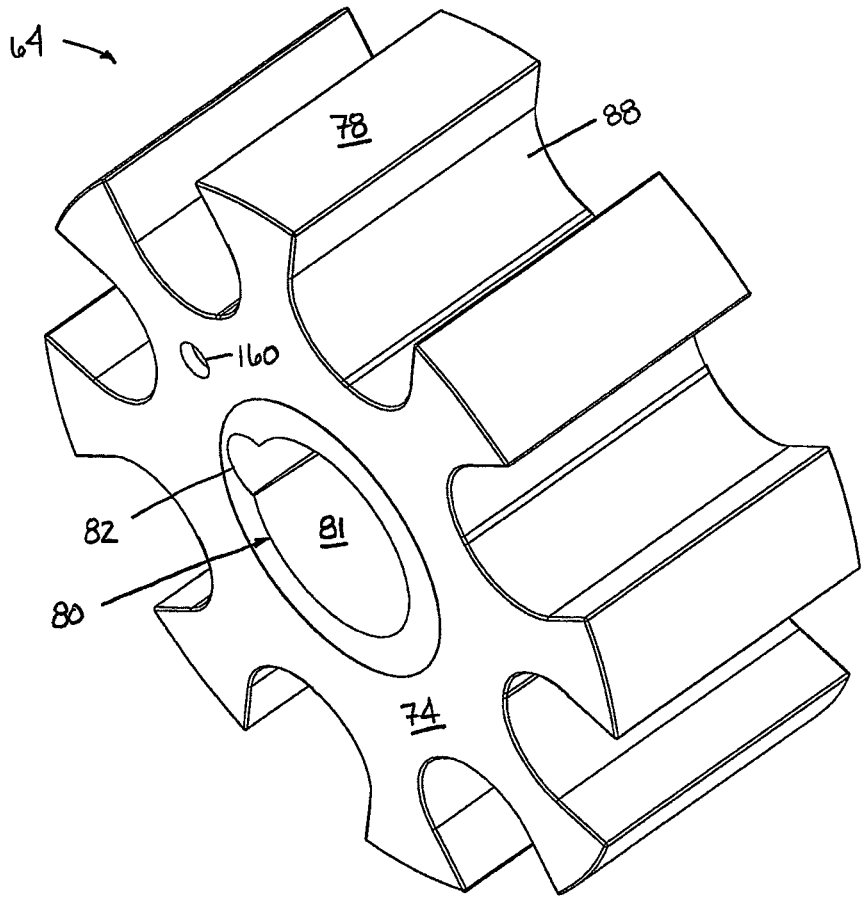
FIG. 5 is isometric view of a rotor assembly suitable for use in the displacement assembly of FIG. 4.
Figure 7:
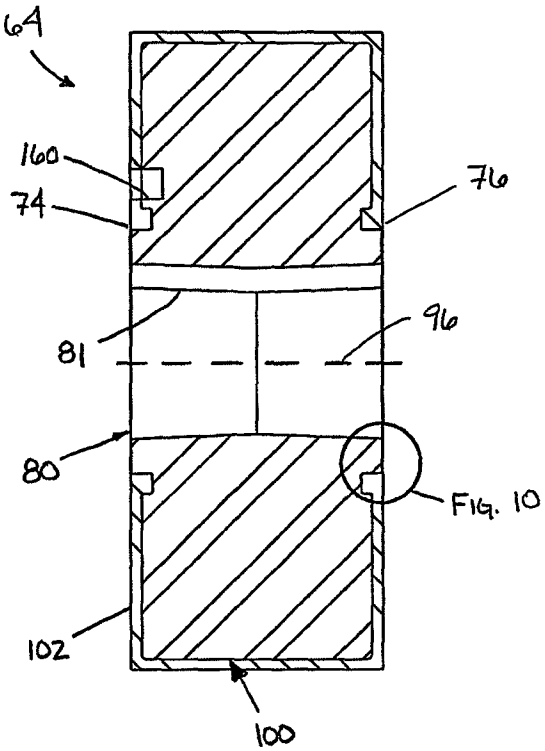
FIG. 7 is a cross-sectional view of the rotor assembly taken on line 7-7 of FIG. 6.
Figure 6:
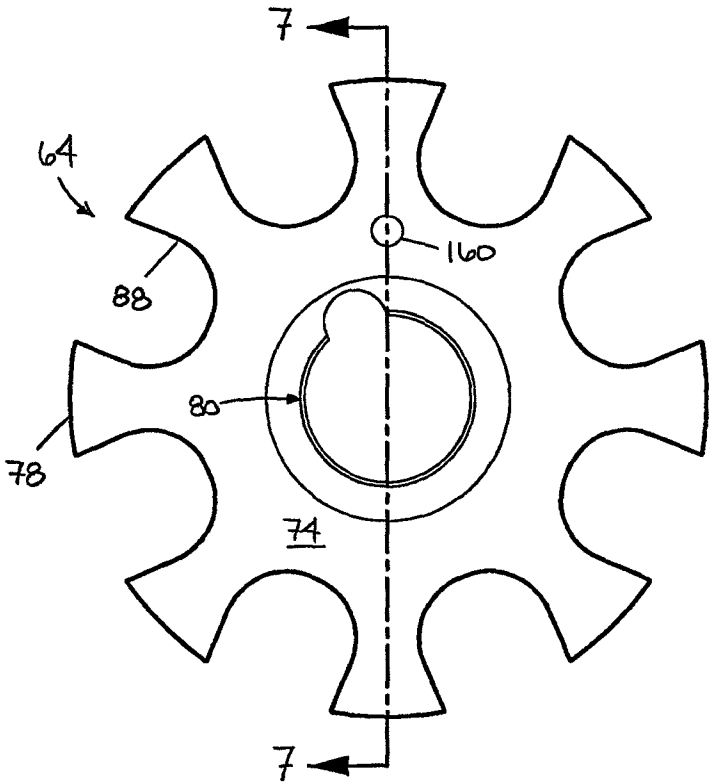
FIG. 6 is a front view of the rotor assembly of FIG. 5.

Referring now to FIGS. 5-7, the rotor assembly 64 is shown. The rotor assembly 64 includes a core, generally designated 100, and a coating 102. The core 100 is manufactured from a first material while the coating 102 is a second material, which is different than the first material. In one embodiment, the first material of the core 100 is grey iron. In another embodiment, the first material is stainless steel. The second material of the coating 102 is a plastic material. In one embodiment, the plastic material of the coating 102 is a water-swellable plastic material.

In one embodiment, the water absorption of the water swellable plastic is greater than or equal to about 1.0% at saturation as measured using the ASTM D570 Standard, which is hereby incorporated by reference in its entirety. In another embodiment, the water absorption of the water swellable plastic is greater than or equal to about 4.0% at saturation as measured using the ASTM D570 Standard. In another embodiment, the water absorption of the water swellable plastic is greater than or equal to about 8% at saturation as measured using the ASTM D570 Standard.

While various water-swellable plastic materials may be suitable for the coating 102, in one embodiment, the water-swellable plastic material of the coating 102 is a glass-filled nylon. Other suitable water-swellable plastic materials include: 33% glass-filled nylon, 33% glass-filled Nylon 6/6, 33% glass-filled Nylon 6, 30% glass-filled Nylon 12, 50% glass-filled Nylon 6, Grilamid LV-3H and Grivory GV-5H.

Figure 9:
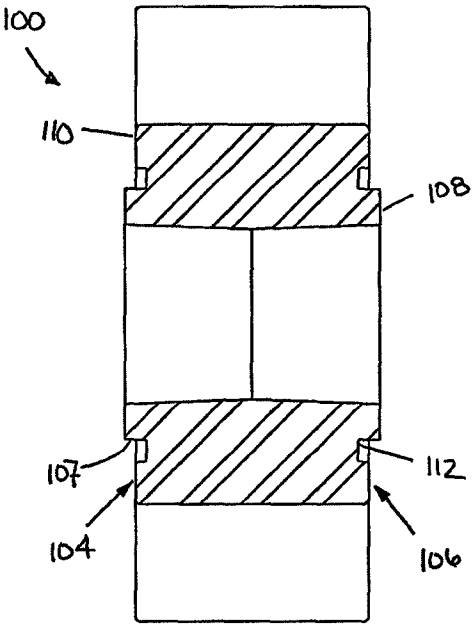
FIG. 9 is a cross-sectional view of the core taken on line 9-9 of FIG. 8.
Figure 8:
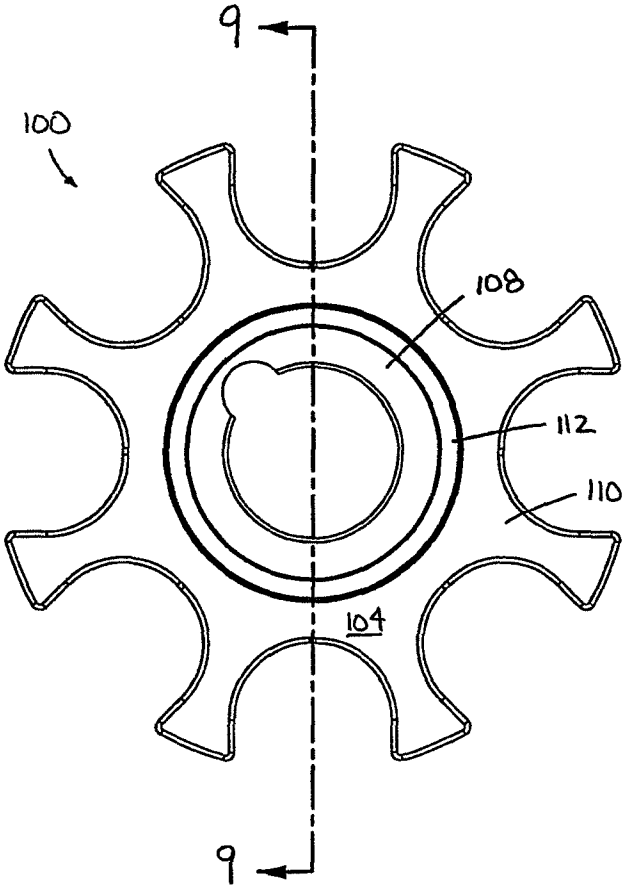
FIG. 8 is a front view of a core of the rotor assembly of FIG. 5.

Referring now to FIGS. 8 and 9, the core 100 is shown. The core 100 includes a first surface 104 and an oppositely disposed second surface 106. In the subject embodiment, each of the first and second surfaces 104, 106 includes a step 107. The first and second surfaces 104, 106 are generally perpendicular to the rotation axis 96 of the rotor assembly 64.

Each of the first and second surfaces 104, 106 include a central portion 108 and a radial portion 110. In the subject embodiment, the central portion 108 is generally circular in shape and surrounds the central bore 80 of the rotor assembly 64. In one embodiment, and by way of example only, the central portion 108 has a diameter less than or equal to about 2 inches. In another embodiment, and by way of example only, the central portion 108 has a diameter less than or equal to about 1.75 inches. In another embodiment, and by way of example only, the central portion 108 has a diameter less than or equal to about 1.5 inches. In another embodiment, and by way of example only, the central portion 108 has a diameter less than or equal to about 1.25 inches.

The radial portion 110 extends radially outward from the central portion 108 to the outer peripheral surface 78. In the subject embodiment, the radial portion 110 is recessed relative to the central portion 108 (best shown in FIG. 9). In one embodiment, and by way of example only, the radial portion 110 is recessed relative to the central portion 108 by an axial distance of less than or equal to about 0.075 inches. In another embodiment, and by way of example only, the radial portion 110 is recessed relative to the central portion 108 by an axial distance of less than or equal to about 0.050 inches.

In the subject embodiment, the radial portion 110 of each of the first and second stepped surfaces 104, 106 defines a retention groove 112. The retention groove 112 is an annular groove that is disposed at the interface between the central portion 108 and the radial portion 110 of the core 100.

Referring now to FIGS. 5-7, the coating 102 coats at least a portion of the core 100. In the subject embodiment, the coating 102 coats the radial portion 110 of each of the first and second surfaces 104, 106 of the core 100, the outer peripheral surface 78 of the core 100 and the pockets 88. In another embodiment, the coating 102 only coats the radial portion 110 of each of the first and second surfaces 104, 106 of the core 100, the outer peripheral surface 78 of the core 100 and the pockets 88. In another embodiment, there is a visual distinction on the first and second axial ends 74, 76 of the rotor assembly 64 between the core 100 and the coating 102.

In the subject embodiment, the coating 102 fills the retention groove 112. This is potentially advantageous as it provides for radial retention of the coating 102 on the core 100.

Figure 10:
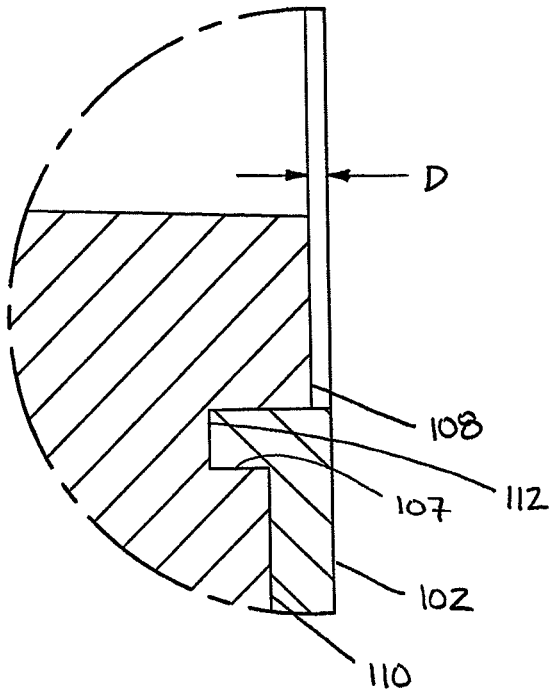
FIG. 10 is an enlarged fragmentary view of the rotor assembly of FIG. 7.
Figure 11:
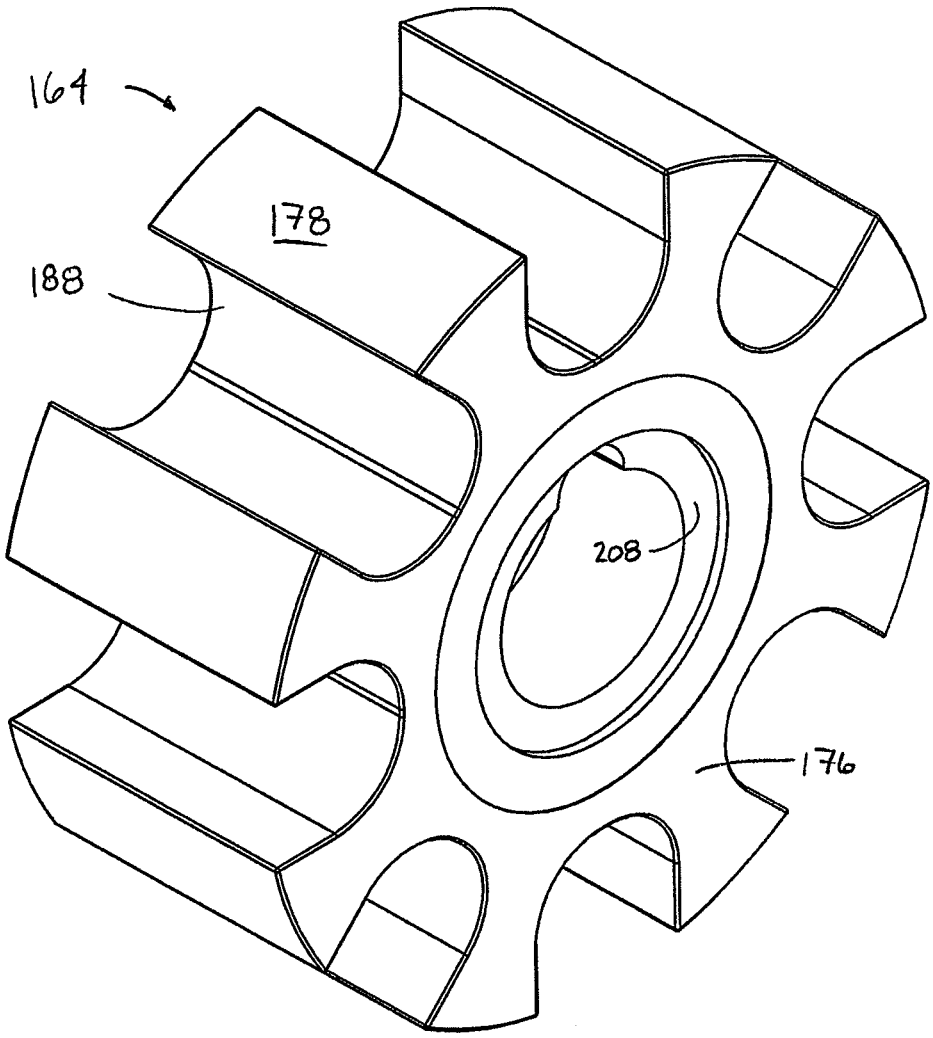
FIG. 11 is an isometric view of an alternate embodiment of a rotor assembly suitable for use in the fluid device of FIG. 1.
Figure 12:
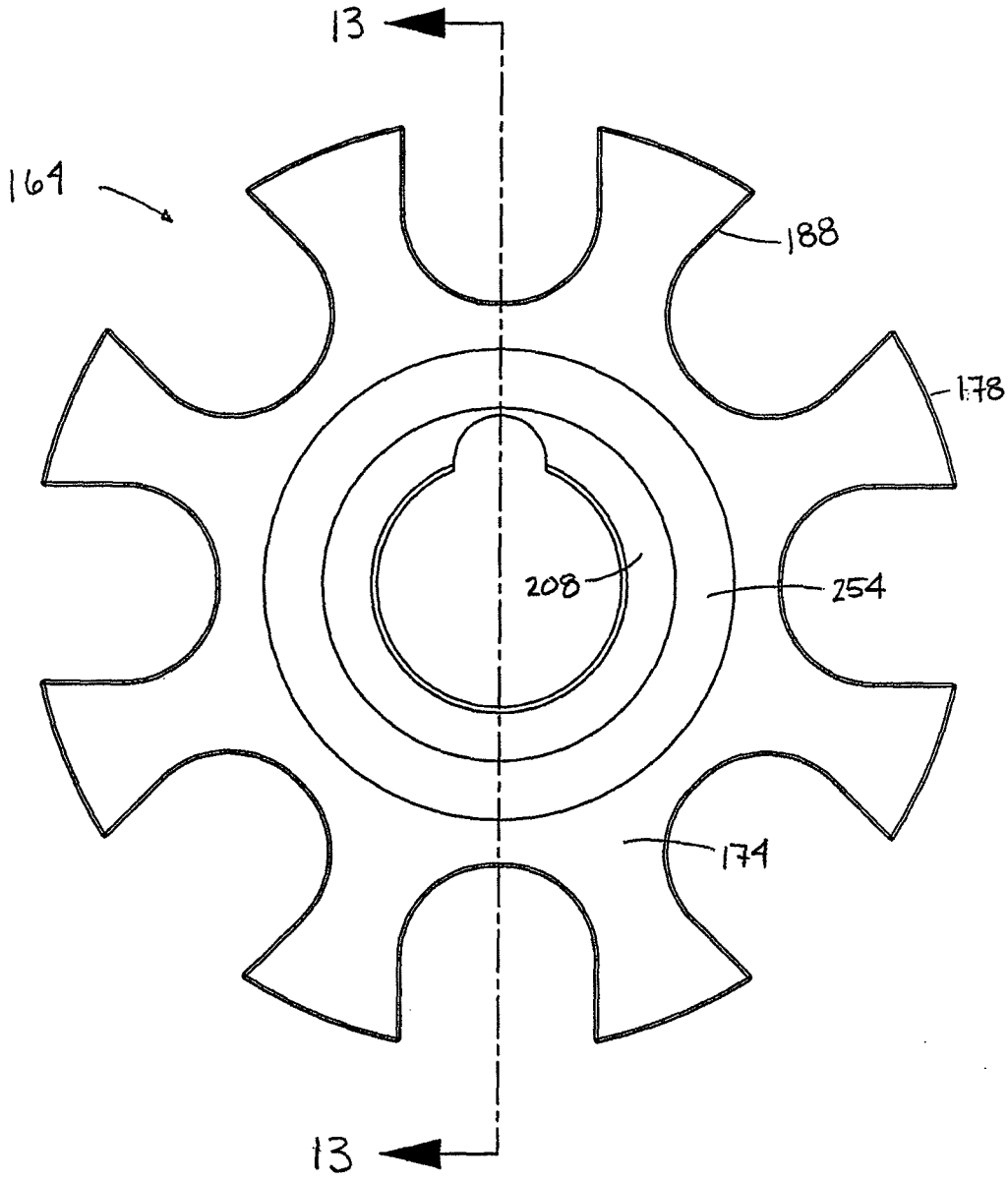
FIG. 12 is a front view of the rotor assembly of FIG. 11.
Figure 13:
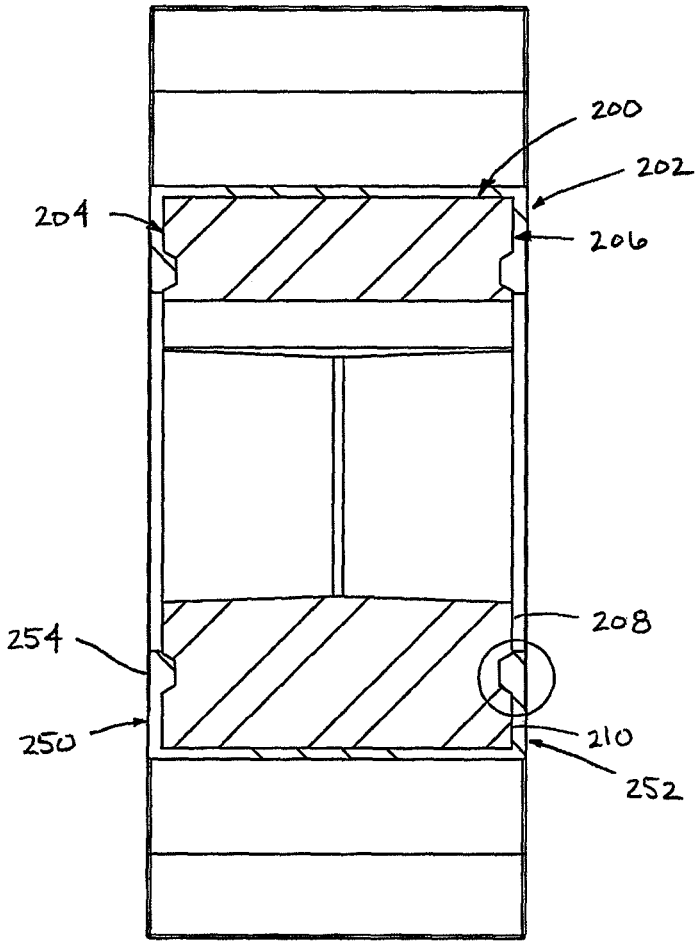
FIG. 13 is a cross-sectional view of the rotor assembly taken on line 13-13 of FIG. 12.
Figure 14:
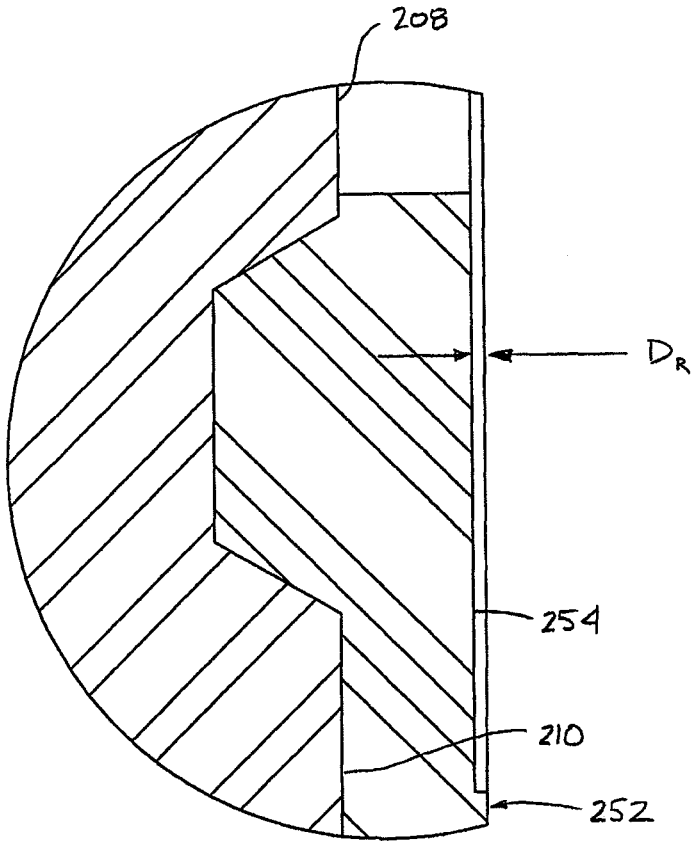
FIG. 14 is an enlarged fragmentary view of the rotor assembly of FIG. 13.

Referring now to FIGS. 6, 7 and 10, the thickness of the coating 102 on the radial portion 110 of the first and second surfaces 104, 106 of the core 100 is greater than the axial distance of the recess of the radial portion 110 relative to the central portion 108 so that the coating 102 extends outwardly from the central portion 108 of the first and second surfaces 104, 106 by an axial distance D. The axial distance D is potentially advantageous as it reduces or eliminates the risk of galling between the central portion 108 of the core 100 and the first end surface 40 of the end plate 20 and between the central portion 108 of the core 100 and the end wall 94 of the base 18. In one embodiment, the axial distance D is less than or equal to about 0.030 inches. In another embodiment, the axial distance D is less than or equal to about 0.020 inches. In another embodiment, the axial distance D is greater than or equal to about 0.005 inches. In another embodiment, the axial distance D is in a range of about 0.005 to about 0.125 inches. In another embodiment, the axial distance D is in a range of about 0.050 to about 0.065 inches.

In one embodiment, the thickness of the coating 102 is uniform over the coated portion of the core 100. In another embodiment, the thickness of the coating 102 on the first and second surfaces 104, 106 of the core 100 is greater than or equal to the thickness of the coating 102 on the pockets 88. In another embodiment, the thickness of the coating 102 on the radial portions 110 of the first and second surfaces 104, 106 of the core 100 is greater than or equal to the thickness of the coating 102 on the pockets 88.

In one embodiment, the rotor assembly 64 is manufactured such that the thickness of the rotor assembly 64 with the coating 102 is greater than the depth of the pumping chamber 68. In one embodiment, the rotor assembly 64 is manufactured such that the thickness of the rotor assembly 64 with the coating 102 is greater than the depth of the pumping chamber 68 by an amount less than or equal to about 0.002 inches. During operation of the fluid device 10, the coating 102 on the first and second axial ends 74, 76 of the rotor assembly 64 wears until the thickness of the rotor assembly 64 is less than or equal to the depth of the pumping chamber 68. This is potentially advantageous as it provides a rotor assembly 64 that has a custom axial fit in the housing 12, which potentially improves the efficiency of the fluid device 10 by reducing a leakage path over the first and second axial ends 74, 76 of the rotor assembly 64.

The use of the coating 102 on the core 100 is potentially advantageous as it reduces the risk of galling between the rotor assembly 64 and the base 18 and/or the end plate 20. During normal operation of conventional pumps, such as conventional roller pumps, there is an axial clearance between the side faces of the all-metal rotor and the immediately adjacent parts. This axial clearance is provided to reduce the risk of galling during normal operation of the conventional pump. However, improper assembly or pressure forces within the conventional pump can result in contact between the side faces of the all-metal rotor and the immediately adjacent parts, which can result in galling during normal operation.

The coating 102 of the rotor assembly 64 of the present disclosure provides a plastic barrier between the core 100 and the end wall 94 of the base 18 and the first end surface 40 of the end plate 20. As a result, the risk for galling between the rotor assembly 64 and the base 18 and/or end plate 20 is reduced.

The use of a water-swellable plastic material for the coating 102 is potentially advantageous as it potentially improves the efficiency of the fluid device 10. As previously mentioned, conventional pumps include an axial clearance between the side faces of the all-metal rotor and the immediately adjacent parts. During normal operation of the conventional pump, the amount of axial clearance increases as a result of wear.

The water-swellable plastic material absorbs water over time. As a result, the thickness of the coating 102 increases during operation of the fluid device. As the thickness of the coating 102 increases, the amount of axial clearance between the rotor assembly 64 and the base 18 and/or the end plate 20 decreases. As the axial clearance decreases, the efficiency of the fluid device 10 increases since leakage over the first and second axial ends 74, 76 of the rotor assembly 64 decreases as the axial clearance decreases. In the event that the water-swellable plastic material swells such that the thickness of the rotor assembly 64 is greater than the depth of the pumping chamber 68, the rotor assembly 64 will wear during operation of the fluid device 10 to provide a custom axial fit as described above.

Referring now to FIGS. 11-14, an alternate embodiment of a rotor assembly 164 is shown. In the embodiment depicted in FIGS. 11-14, features of the rotor assembly 164 that are similar to those previously described will be identified by same reference numerals as those previously utilized plus "100" while new features will be identified by reference numerals greater than or equal to "250." The rotor assembly 164 includes a first axial end 174, an oppositely disposed second axial end 176 and an outer peripheral surface 178 that extends between the first and second axial ends 174, 176.

The outer peripheral surface 178 defines a plurality of pockets 188. In the subject embodiment, the pockets 188 extend radially inward from the outer peripheral surface 178 and extend axially through the first and second axial ends 174, 176.

The rotor assembly 164 includes the core 200 and a coating 202. The core 200 includes a first surface 204 and an oppositely disposed second surface 206. Each of the first and second surfaces 204, 206 includes a central portion 208 and a radial portion 210. The radial portion 210 extends radially outward from the central portion 208 to the outer peripheral surface 178.

The coating 202 coats at least a portion of the core 200. In the subject embodiment, the coating 202 coats the radial portion 210 of each of the first and second surfaces 204, 206 of the core 200, the outer peripheral surface 178 of the core 200 and the pockets 188.

The coating 202 includes a first axial end portion 250 and an oppositely disposed second axial end portion 252. The first axial end portion 250 coats the radial portion 210 of the first surface 204 of the core 200 while a second axial end portion 252 coats the radial portion 210 of the second surface 206 of the core 200.

Each of the first and second axial end portions 250, 252 of the coating 202 defines a recess portion 254. The recess portion 254 surrounds the central portion 208 of the core 200. The recess portion 254 of each of the first and second axial end portion 250, 252 is recessed by a depth $D_R$. In one embodiment, the depth $D_R$ is about 0.005 inches.

Figure 15:
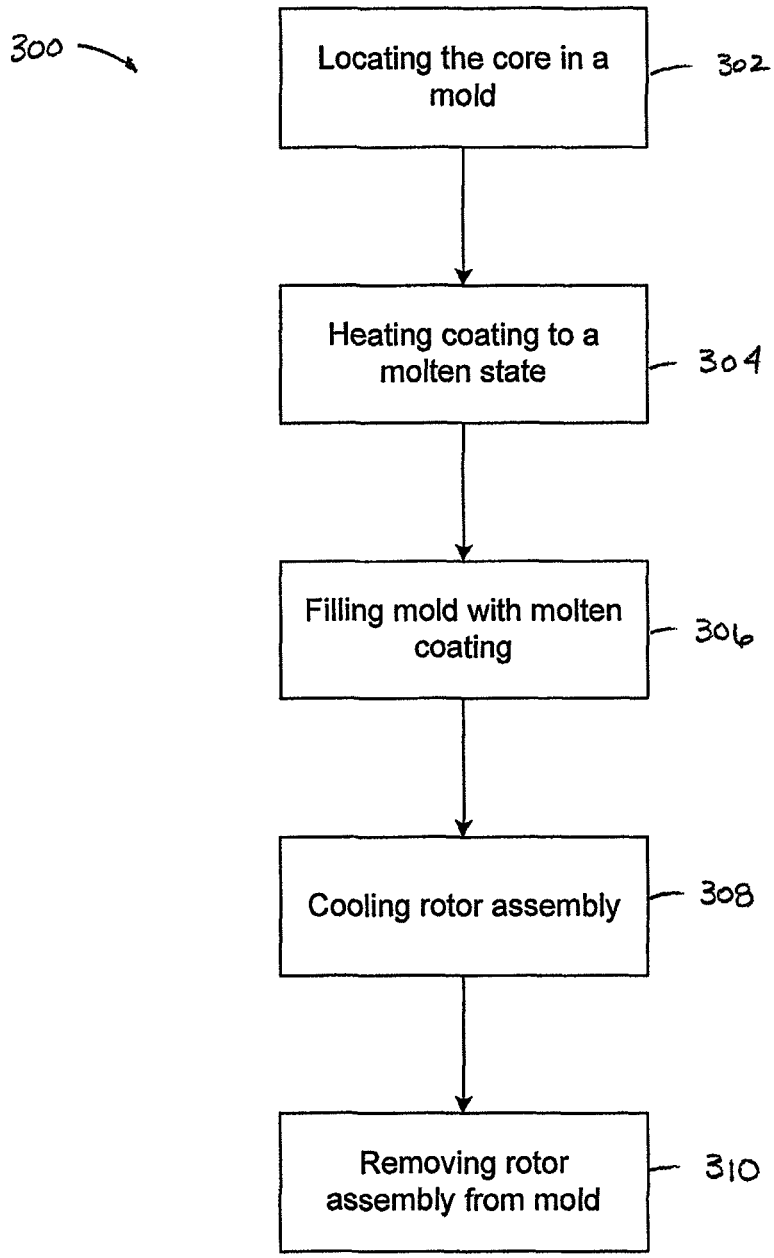
FIG. 15 is a method for applying a coating to the core of the rotor assembly having exemplary features of aspects in accordance with the principles of the present disclosure.

Referring now to FIGS. 6, 7 and 15, a method 300 for applying the coating 102 to the core 100 will be described. In step 302, the core 100 is located in a mold. The mold defines a cavity having the finished shape of the rotor assembly 64. In one embodiment, the core 100 is radially and axially located in the mold using the central bore 80 of the core 100. In another embodiment, the core 100 is radially and axially located in the mold using the oblique tapered surface 81 of the central bore 80 of the core 100. The core is rotationally located in the mold using a locator pin disposed in the mold. The locator pin is adapted for engagement with a locator hole 160 defined by the radial portion 110 of the core 100.

In step 304, the coating 102 is heated to a molten state. In one embodiment, the water-swellable material is heated to a temperature greater than or equal to about 500° F. In another embodiment, 33% glass-filled nylon is heated to a temperature greater than or equal to about 550° F.

In step 306, the mold is filled with the molten coating 102. The mold may be filled by injection, pumping, pouring, etc. In step 308, the molten coating 102 in the mold is allowed to cool. The molten coating 102 may be cooled by air cooling, forced air cooling, refrigeration, etc. In one embodiment, the molten coating 102 cools forming the coating 102 of the rotor assembly 64 in less than or equal to about 1 minute. In another embodiment, the molten coating 102 cools forming the coating 102 of the rotor assembly 64 in less than or equal to about 20 seconds. In another embodiment, the molten coating 102 cools forming the coating 102 of the rotor assembly 64 in less than or equal to about 15 seconds. In step 310, the rotor assembly 64 is removed from the mold.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A fluid device comprising:

a housing;

a rotor assembly disposed in the housing, the rotor assembly including:

a core having a first surface, an oppositely disposed second surface and an outer peripheral surface that extends between the first and second surfaces, the core defining a bore that extends through the first and second surfaces; and a coating that coats at least a portion of the first and second surfaces and the outer peripheral surface of the core, the coating being a water-swellable plastic material, wherein a thickness of the water-swellable material on the first and second surfaces is greater than a thickness of the water-swellable material on the outer peripheral surface.

2. A fluid device as claimed in claim 1, wherein the outer peripheral surface defines a plurality of pockets with each pocket adapted to receive a roller.

3. A fluid device as claimed in claim 1, wherein the bore includes an oblique tapered surface.

4. A fluid device as claimed in claim 1, wherein each of the first and second surfaces includes a central portion and a radial portion, wherein the radial portion is recessed relative to the central portion.

5. A fluid device as claimed in claim 4, wherein the radial portion defines a retention groove at the interface between the radial portion and the central portion.

6. A fluid device as claimed in claim 4, wherein only the radial portion of the first and second surfaces and the outer peripheral surface of the core are coated with the water-swellable material.

7. A fluid device as claimed in claim 1, wherein the water-swellable plastic material is glass-filled nylon.

8. A fluid device comprising:

a housing;

a rotor assembly disposed in the housing, the rotor assembly including:

a core having a first surface, an oppositely disposed second surface and an outer peripheral surface extending between the first and second surfaces, the core defining a bore that extends through the first and second surfaces; and a coating that coats at least a portion of the core, the coating being a water-swellable plastic material, wherein the water-swellable plastic material is 33% glass-filled nylon.

9. A rotor assembly adapted for rotation in a fluid device, the rotor assembly comprising:

a core having:

a first surface and an oppositely disposed second surface, each of the first and second surfaces having a central portion and a radial portion, wherein the radial portion is recessed relative to the central portion;

an outer peripheral surface extending between the first and second surfaces; and a coating applied to the radial portion of each of the first and second surfaces of the core and the outer peripheral surface of the core, wherein the coating is a water-swellable plastic material and a thickness of the water-swellable material on the first and second surfaces is greater than a thickness of the water-swellable material on the outer peripheral surface.

10. A rotor assembly as claimed in claim 9, wherein the coating extends outwardly from the first and second surfaces by an axial distance that is in a range of about 0.005 inches to about 0.125 inches.

11. A rotor assembly as claimed in claim 9, wherein the core defines a plurality of pockets, each of the plurality of pockets being adapted for engagement with a roller.

12. A rotor assembly as claimed in claim 9, wherein the radial portion of each of the first and second surfaces defines a retention groove disposed at the interface between the radial portion and the central portion.

13. A rotor assembly as claimed in claim 9, wherein the core defines a central bore that extends through the first and second surfaces, the central bore defining an oblique tapered surface.

14. A displacement assembly for pumping fluid, the displacement assembly comprising:

a ring having an inner surface defining a pumping chamber;

a rotor assembly disposed in the pumping chamber and being adapted for rotation in the pumping chamber, the rotor assembly includes:

a core having a first surface, an oppositely disposed second surface and an outer peripheral surface that extends between the first and second surfaces, each of the first and second surfaces including a central portion and a radial portion, the core defining a central bore that extends through the central portions of the first and second surfaces and a plurality of pockets that extend radially inward from the outer peripheral surface;

a coating that coats the radial portion of the first and second surfaces of the core, the coating being a plastic material that extends outwardly from the radial portion of each of the first and second surfaces by an axial distance that is in a range of about 0.005 inches to about 0.125 inches as measured from the central portion, the plastic material of the coating being a water-swellable plastic material having a water absorption value at saturation greater than or equal to 1% as measured in accordance with the ASTM D570 Standard; and a plurality of rollers with one roller disposed in each of the plurality of pockets of the rotor assembly, wherein the inner surface of the ring, the plurality of pockets of the rotor assembly and the rollers cooperatively define a plurality of volume chambers.

15. A displacement assembly as claimed in claim 14, wherein the water-swellable plastic material is glass-filled Nylon.

16. A displacement assembly as claimed in claim 15, wherein the central bore includes an oblique tapered surface.

* * * * *